United States Patent [19]

Thompson

[11] 4,416,668

[45] Nov. 22, 1983

[54] ANTISTATIC AGENTS FOR ORGANIC LIQUIDS

[75] Inventor: Neil E. S. Thompson, Creve Coeur, Mo.

[73] Assignee: Petrolite Corporation, St. Louis, Mo.

[21] Appl. No.: 385,179

[22] Filed: Jun. 4, 1982

Related U.S. Application Data

[63] Continuation of Ser. No. 954,512, Oct. 25, 1978.

[51] Int. Cl.[3] ..... C10L 1/22; C10L 1/24

[52] U.S. Cl. ..... 44/62; 44/63; 44/DIG. 2; 44/76; 260/DIG. 17

[58] Field of Search ..... 44/62, 63, DIG. 2; 526/23, 52.5; 260/DIG. 17

[56] References Cited

U.S. PATENT DOCUMENTS

| | | | |
|---|---|---|---|
| 2,459,518 | 8/1969 | Mehmedbasich | 44/62 |
| 3,909,215 | 9/1975 | Kray | 44/62 |
| 3,917,466 | 11/1975 | Henry, Jr. | 44/62 |
| 3,929,655 | 12/1975 | Gattuso | 44/62 |
| 3,930,810 | 1/1976 | Gattuso | 44/56 |

*Primary Examiner*—Jacqueline V. Howard

*Attorney, Agent, or Firm*—Sidney B. Ring; Hyman F. Glass; Leon J. Berkovitz

[57] ABSTRACT

This invention relates to imides of α-olefin-maleic copolymers and to blends of imides of α-olefin-maleic copolymer and α-olefin-sulfur dioxide copolymers; and to systems, such as hydrocarbon fuels, containing such compositions as antistatic agents.

6 Claims, No Drawings

ANTISTATIC AGENTS FOR ORGANIC LIQUIDS

This is a continuation, of application Ser. No. 954,512, filed Oct. 25, 1978.

This invention relates to organic liquids having desirable anti-static properties, and, in one of its aspects, relates more particularly to organic liquid compositions in the form of volatile organic liquids such as hydrocarbon fuels or solvents which possess low electrical conductivity which, when they accumulate electrostatic charges, may rise to the hazards of ignition or explosion. Still more particularly in this aspect, the invention relates to the improvement of such organic liquids by incorporating therein, additives which are effective in increasing the electrical conductivity of such liquids to the extent that accumulation of electrostatic charges, with attendant danger of ignition or explosion, is significantly minimized, particularly in the handling, transportation or treatment of such liquids.

The low electrical conductivity of many volatile organic liquid compositions has presented the problem of controlling static buildup, particularly during handling and transportation, for the purpose of insuring safe and effective distribution without the concomitant danger of ignition or explosion. For example, volatile organic liquids such as hydrocarbon fuels (e.g. gasoline, jet fuels, turbine fuels and the like), or light hydrocarbon oils employed for such purposes as solvents or cleaning fluids for textiles, possess a very low degree of electrical conductivity. In the use of such fluids, electrostatic charges, which may be generated by handling, operation or other means, tend to form on the surface, and may result in sparks, thus resulting in ignition or explosion. These hazards may be encountered merely in the handling or transportation of such organic liquids and even in operations, such as centrifuging, in which a solid is separated from a volatile liquid, during which electrostatic charges can accumulate.

Various materials have heretofore been proposed for incorporation into such organic liquid compositions for increasing their electrical conductivity and thus reduce the aforementioned dangers of ignition and explosion.

The following are examples of patents which describe antistatic agents employed in fuels:

(1) α-olefin-sulfone copolymers

U.S. Pat. No. 3,578,421
U.S. Pat. No. 3,677,724
U.S. Pat. No. 3,807,977
U.S. Pat. No. 3,811,848
U.S. Pat. No. 3,917,466

(2) α-olefin-maleic anhydride copolymers

U.S. Pat. No. 3,677,725

(3) amines and methyl vinyl ether-maleic anhydride copolymers.

U.S. Pat. No. 3,578,421

(4) aliphatic amines-fluorinated Polyolefins

U.S. Pat. No. 3,652,238

(5) chromium salts and amine phosphates

U.S. Pat. No. 3,758,283

We have now discovered that α-olefin-maleimide copolymers and blends of said α-olefin-maleimide copolymers and α-olefin-sulfur dioxide copolymers are excellent antistatic agents, particularly when incorporated into an organic liquid such as a hydrocarbon fuel.

The α-olefin-maleimide copolymers are compositions ideally presented as containing the following polymer unit:

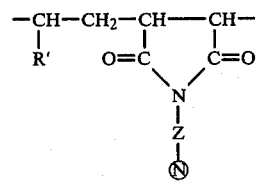

where R′ is the moiety of the α-olefin such as alkyl, etc. and Z represents the moiety of the dangling group having a terminal amino group represented by Ⓝ.

Thus, the amine employed to form the imide is a polyamine, preferably a diamine, capable of reacting with the maleic group to form an imide while retaining a dangling terminal amino group. The preferred composition is where the terminal amino group is sterically hindered.

Although the basic polymer contains the following polymeric unit:

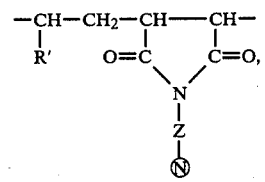

the polymer may contain other copolymeric units which may contain acid, ester, and/or amide groups, for example, the following copolymeric units

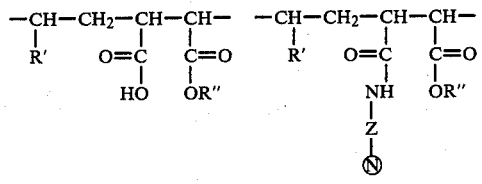

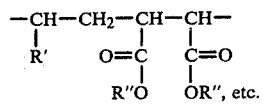

where R′ is alkyl, etc. and R″ is an alcohol moiety. In certain systems these other polymeric units yield improved properties.

The antistatic compositions of this invention comprise (1) polysulfone copolymer derived from the copolymerization of sulfur dioxide with 1-alkene of 6 to 24 carbon atoms and an optional olefin having the formula indicated herein, and (2) an α-olefin-maleimide copolymer.

Also included within the scope of this invention are liquid hydrocarbon fuels of high electrical conductivity consisting essentially of a hydrocarbon boiling in the range of 70° F. to about 700° F. and the antistatic composition as defined herein in an effective antistatic amount. The weight ratio of the polysulfones copolymer to α-olefin-maleimide copolymer is from about 100:1 to about 1:100.

The polysulfone copolymers useful in the invention are copolymers consisting essentially of about 50 mol percent of units derived from (1) $SO_2$, i.e., sulfur dioxide, from about 40 to about 50 mol percent of units derived from (2) $CH_2{=}CHR$, wherein R is an alkyl group of from about 4 to 22 carbon atoms, i.e., 1-alkenes of about 6 to 24 carbon atoms. The polysulfone copolymers, often designated as olefin-sulfur dioxide copolymer, olefin polysulfones, or poly(olefin sulfone) are linear polymers wherein the structure is considered to be that of alternating copolymers of the olefins and sulfur dioxide, having a one-to-one molar ratio of the comonomers with the olefins in head to tail arrangement. Since the polysulfones are inexpensive and are usually light-colored, amorphous, readily moldable and extrudable, considerable effort has been expended to prepare new types or to improve the properties of the polymer for a general use as a thermoplastic polymer. The polysulfones used in this invention are readily prepared by the methods known of the art (cf. Encyclopedia of Polymer Science and Technology Vol. 9, Interscience Publishers, page 460 et seq.). The reaction leading to polysulfone formation is considered to be a free radical polymerization process. Almost all types of radical initiators are effective in initiating polysulfone formation. Radical initiators such as oxygen, ozonides, peroxides, hydrogen peroxide, ascaridole, cumene peroxide, benzoyl peroxide, azobisisobutyronitrile are examples of some of the useful initiators. Polysulfone formation can also be initiated by irradiation with visible light.

The olefins useful for the preparation of the polysulfones are 1-alkenes of about 6 to 24 carbon atoms. The 1-alkenes are generally available commercially as pure or mixed olefins from petroleum cracking process or from the polymerization of ethylene to a low degree. The useful 1-alkenes include for example 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonodecene, 1-eicosene, 1-heneicosene, 1-ducosene, 1-tricosene and 1-tetracosene. While the normal straight chain 1-alkenes are preferred, it is understood that 1-alkenes containing branched chains are also useful. It is also understood that a mixture of 1-alkenes may be used and may often be desirable since a mixture of 1-alkenes are often obtainable at a lower cost than are pure olefins. The olefin portion of the polysulfone should be an olefin of at least 6 carbon atoms to insure that the polysulfone is sufficiently soluble in hydrocarbons. For practical and economic reasons, the olefin used for the preparation of polysulfone should have less than about 24 carbon atoms. The preferred olefins will have from about 8 to about 12 carbon atoms, the most preferred olefin having 10 carbon atoms, i.e., 1-decene polysulfone.

While olefin polysulfones, as described are effective conductivity increasing additives in hydrocarbon fuels, it has been found that in certain fuels, in order to obtain the desired high initial or instantaneous conductivity, of approximately 200 picomhos per meter, relatively large amounts of olefin polysulfones are required. Since the hydrocarbon fuels treated with olefin polysulfones have the unusual characteristics of continuing to increase in conductivity with time, the treated hydrocarbon fuels will, after a period of time, have conductivities of up to about seven times the initial conductivities. In order to minimize the treating cost, it is desirable to minimize the amount of the additive required to produce the desired effect. In other words, it is desirable to provide a conductivity additive which can impart high conductivity to the fuel instantaneously and maintain a high conductivity level for long periods of time.

It has now been found that a combination of olefin polysulfone and an α-olefin-maleimide copolymer at very low concentrations, provide high initial conductivity as well as long-lasting conductivity. Concentrations as low as a few tenths of part per million (ppm) have been found sufficient to demonstrate increased conductivity. It is wholly unexpected and surprising that the combination of olefin polysulfone and α-olefin-maleimide copolymer exhibits conductivity significantly greater than that attributable to each of the individual components of the combination.

The ratio of olefin polysulfone to α-olefin-maleimide copolymer may be from about 100:1 to about 1:100, preferably in the range of from about 50:1 to about 1:1, most preferably in the range of from about 20:1 to about 1:1. The most preferred ratios afford compositions which are economical to use, are effective in increasing conductivity and do not adversely affect other desirable characteristics of the hydrocarbon fuels. The preferred olefin polysulfone to be used in this invention is 1-decene polysulfone; and the preferred α-olefin-maleimide copolymer contains the following polymeric unit:

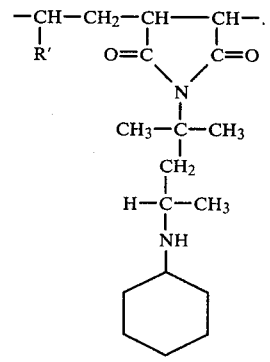

The amount of the invention compositions to be added to the hydrocarbon fuels will depend upon the combination chosen, the electrical conductivity desired and the particular hydrocarbon fuel. It is recognized that the electrical conductivity of liquid hydrocarbons will vary depending upon the particular source of the hydrocarbon and its processing history. Usually the hydrocarbon fuels in the gasoline boiling range have very low conductivities (0–10 picomhos/meter) while those in the fuel oil range have somewhat higher conductivities (20–30 picomhos/meter). It is also recognized that the response of hydrocarbon fuels to conductivity-increasing additives may also vary unpredictably. Generally when the compositions of the invention are added to hydrocarbon fuels at a level as low as a few tenths of a part per million (ppm), increased conductivity is evident. In responsive fuels, concentrations of 1 to 10 parts per million are sufficient to give initial conductivities greater than 200 picomhos per meter whereas in poorly responsive fuels, concentrations greater than 10 parts per million may be required. Since as mentioned earlier, a hydrocarbon conductivity of 50 picomhos per meter is considered to be sufficient for safe handling (or 200 picomhos/meter for an extra margin of safety), usually a sufficient amount of the compositions of the invention is added to the hydrocarbon fuel to obtain the initial conductivity of 50 picomhos/meter (or 200 picomhos/meter, if desired), although greater amounts may be used.

The normally liquid hydrocarbon fuels to which the compositions of the invention are added to render such hydrocarbon fuels electrically conductive are those boiling in the range of about 70° to 700° F., and include such commonly designated fuels as aviation gasolines, motor gasolines, jet fuels, naphtha, kerosene, diesel fuels and distillate burner fuel oils. The compositions may be added to the hydrocarbon fuels in any convenient manner. Each individual component of the composition may be added to the hydrocarbon fuels separately or the composition may be added as a simple mixture or as a solution in a solvent such as benzene, toluene, or xylenes, and stirred to obtain a uniform distribution. Generally, since it is preferable to prepare the olefin polysulfones in the presence of solvents such as those listed above, it is more convenient to add the olefin polysulfone as a solution in the solvent in which it is prepared. The concentrations of olefin polysulfones in the solvent may conveniently be in the range of from about 10 percent by weight to about 60 percent by weight. The α-olefin-maleimide copolymer may be added to the olefin polysulfone solution so that the resultant composition may be added to the hydrocarbon fuels as a solution. The hydrocarbon fuel compositions containing one or more compositions of the invention as antistatic additive may also contain conventional additives used in hydrocarbon fuels such as anti-knock compounds, antioxidants, corrosion inhibitors, metal deactivators, ruse preventatives, dyes, anti-icing agents and the like.

EXAMPLES

The following examples are intended to be merely illustrative of the invention and not in limitation thereof.

Unless otherwise indicated, all quantities are by weight.

In these examples, all conductivity measurements were made with a Maihak Conductivity Indicator (H. Maihak A. G., Hamburg, Germany). In operation the device imposes a potential of 6 volts of direct current on a pair of chromium plated electrodes immersed in the fluid to be tested. The current resulting from this potential, which is of the order of $10^{-9}$ to $10^{-8}$ ampere, is amplified and used to actuate a dial calibrated in conductivity units. A conductivity unit is 1 picomho per meter.

EXAMPLE 1

This example describes the preparation of 1-decene polysulfone. A solution of 10 ml of Igepal CO-710 [nonyl phenoxy poly(ethyleneoxy) ethanol] in 320 grams of tap water was charged into a pressure reactor. The reactor was evacuated and flushed with nitrogen three times to remove oxygen. Then 84 grams (0.60 mole) of 1-decene, 48 grams (0.75 mole) of $SO_2$, and a solution of 0.4 grams of t-butyl hydroperoxide in 47 grams of deionized water were added. The emulsion was stirred for 24 hours at room temperature. The reactor was then opened and the appearance of the latex noted. The latex was then mixed with 360 grams of solvent 14 and transferred to a distillation flask, where the water was removed by azeotropic distillation under reduced pressure.

EXAMPLES 2–4

Using the same procedure described in example 1, other 1-olefin polysulfones were prepared. Some of these 1-olefin polysulfones are summarized below.

| Example | Olefin used |
|---|---|
| 2 | 1-dodecene |
| 3 | 1-tetradecene |
| 4 | 1-octadecene |

The imides of α-olefin-maleic copolymers relate to compositions ideally presented as containing the following unit:

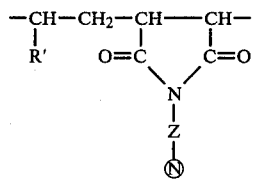

where R′ is the moiety of the α-olefin such as alkyl, etc. and Z represents the moiety of the dangling group having a terminal amino group represented by Ⓝ.

Thus, the amine employed to form the imide is a polyamine, preferably a diamine, capable of reacting with the maleic group to form an imide while retaining a dangling terminal amino group. The preferred composition is where the terminal amino group is sterically hindered.

Although the basic polymer (showing the preferred diamine by way of illustration) contains the following polymeric units

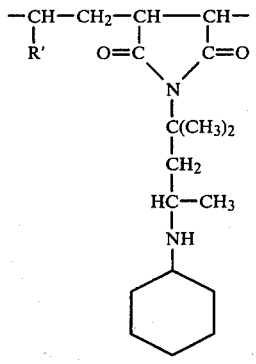

the polymer may contain other copolymeric units which may contain acid, ester, and/or amide groups, for example, the following copolymeric units:

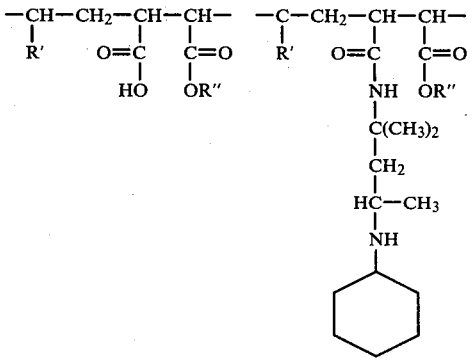

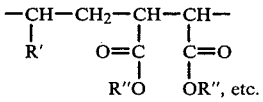

where R′ is alkyl, etc. and where R″ is an alcohol moiety. In certain systems those other polymeric units yield improved properties.

The following illustrates the type of polymeric polymer.

α-olefin/maleic anhydride copolymers, which are well known, are prepared by copolymerizing substantially equimolar amounts of an α-olefin and maleic anhydride. Preferred α-olefins contain between about 2 to 28 carbon atoms per molecule. α-olefins containing a greater number of carbon atoms can also be employed, for example, having as high as about 50 carbon atoms; mixtures of α-olefins can also be employed.

The following is an idealized formula of α-olefins:

$$RCH{=}CH_2$$

where R is alkyl, for example having from about 4 to 50 or more carbons. They may be linear or branched.

The α-olefins employed in preparing the α-olefin sulfur dioxide copolymer can also be employed in preparing the α-olefin/maleic anhydride copolymers. These α-olefins are presented above.

Several of the aforementioned α-olefin-maleic anhydride copolymers are commercially available materials and are well known in the art and are readily prepared by heating maleic anhydride and one or more α-olefins, preferably in the presence of a peroxidic catalyst. Their preparation is shown for example in U.S. Pat. Nos. 3,560,456; 3,677,725; 3,729,451 and 3,729,529. These polymers vary in molecular weight from a few hundred to a few thousand. These polymers are described in the literature as linear and having the following formula

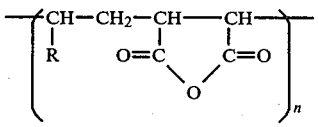

wherein n is an integer greater than 1 and where R is the moiety of the α-olefin such as alkyl, etc.

A wide variety of diamines of the type described herein can be employed. The diamines have the following general formula

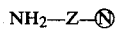

where Z is group whose backbone is primarily alkylene and Ⓝ is a blocked or sterically hindered group, i.e., will not react under conditions of reaction. The alkylene backbone has from about 2 to 10 or more carbons such as from about 2 to 12 carbons but preferably from about 3 to 5 carbons. The alkylene may or may not be a tertiary group such as

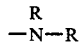

where R is alkyl, cycloalkyl, etc., or hydrogen.

The preferred amines are those described in Ser. No. 597,564 filed July 21, 1975 which have the general formula

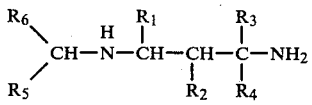

where the R groups, which may be the same or different, are hydrogen or a substituted group such as alkyl, aryl, cycloalkyl, aralkyl, alkaryl, heterocyclic, substituted derivatives thereof, etc. In addition the R groups may be joined in a cyclic configuration.

Typical examples are the following:

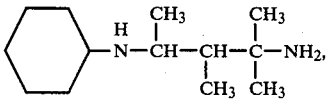

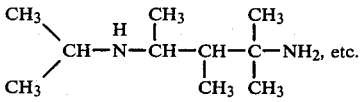

Unless the reaction between the α-olefin-maleic copolymer is carefully carried out or carried out in a specific manner cross-linking or gelling may occur. In order to prevent cross-linking or gelling we carry out the reaction in accord with the following equations:

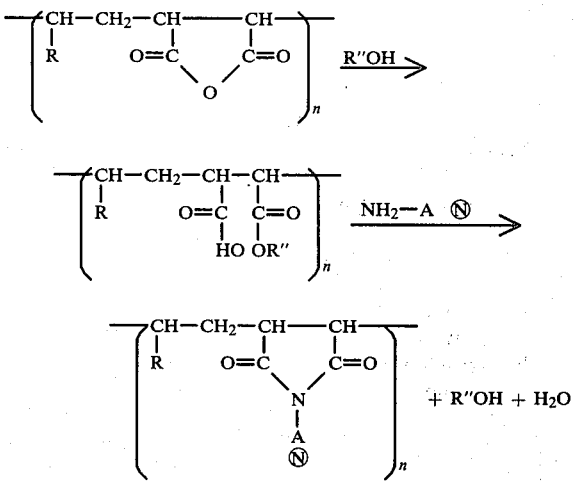

One equivalent of the α-olefin-maleic anhydride copolymer was heated to reflux with 20 weight % amyl alcohol and 50 weight % xylene for about 1 hour and then cooled to 100° to 110° C. To this solution was added 1.01 mole of amine. The reaction mixture thickened quickly and then thinned as the temperature was raised to reflux. Water and alcohol were azeotropically distilled off until the reaction was completed.

The most preferred (Olefin-N-alkyl maleimide) copolymer is (octadecene-N-(N-cyclohexyl 2,4-diamino-2 methyl pentane) maleimide) copolymer, having the following unit:

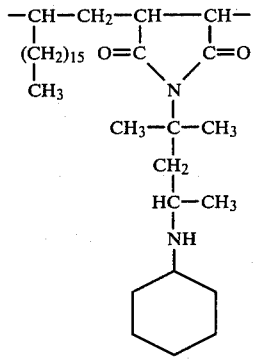

A number of N-alkyl 1,3-propylene diamines are suitable for this invention. Illustrative examples of these diamines include, dimethylaminopropylamine, N-octyl, N-nonyl, N-decyl and N-dodecyl derivatives of propylenediamine, N-isopropyl-2,4-diamino-2-methyl pentane and N-cyclohexyl-2,4-diamino-2-methyl pentane. The preferred diamine is N-cyclohexyl-2,4-diamino-2-methyl pentane, having the formula,

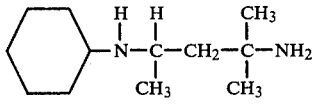

EXAMPLE 1A

This example describes the preparation of the (tetradecene-maleic anhydride) copolymer.

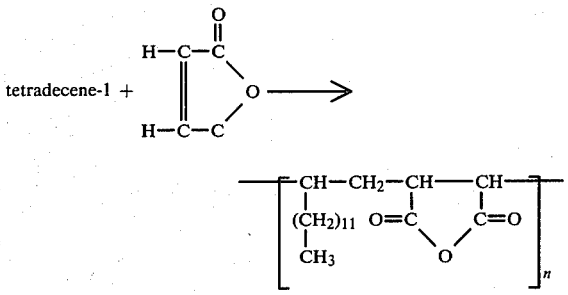

A 1-liter resin kettle equipped with a stirrer, reflux condenser, a thermometer and gas inlet tube was swept with dry nitrogen. To the flask were added 55 g (0.56 m) maleic anhydride, 25 gm. chlorobenzene, 110 gm Shell Solvent 71, and 138 gm tetradecene-1. The reaction was then heated to about 60° C. until the maleic anhydride was all in solution. The pot temperature is then raised to 130° C. and 0.7 gm di-t-butyl peroxide is added. The temperature is then maintained between 135°-140° C. for 3 hours, during which time the reaction mass becomes viscous. An additional 1.0 g di-t-butyl peroxide was added and heating was continued for 8 hours. The mixture is then cooled to 100° C. and a sample taken for distillation analysis and non-volatile. Commercial quantities of several (Olefin-maleic anhydride α-olefin polymers are also available, for example, *Gulf's polyanhydride resins, PA-10, PA-14, and PA-18. These are equally effective in this invention.

*Gulf Oil Chemicals Company.

EXAMPLES 2A-4A

Using the same procedure described in example 1A, other 1-olefin-maleic anhydride copolymers were prepared. Some of these are listed below:

| Example | 1-olefin used |
|---|---|
| 2A | 1-decene |
| 3A | 1-dodecene |
| 4A | 1-octadecene |

EXAMPLE 5A

This example describes the preparation of [tetradecene-N(N-cyclohexyl-2,4-diamino-2-methyl pentane)-maleimide] copolymer. To a 500 ml flask equipped with stirrer, thermometer and a Dean Stark condenser for water removal were added 29.4 g (0.1 m) (tetradecene-maleic anhydride) copolymer (Example 1A), 10 cc of amyl alcohol and 100 cc xylene. The mixture was stirred at 120°-140° C. for 0.75 hour. To this solution was added 19.8 g (0.1 m) N-cyclohexyl-2,4-diamino-2-methyl pentane. The reaction mixture thickened quickly and then thinned as the temperature was raised to reflux. Water and amyl alcohol were azeotropically distilled off. At the end of 5 hours 90-95% of the theoretical amount of water was collected (1.7 cc). The mixture was cooled to 50° C. and the clear homogenous solution was diluted with xylene to make a 20% active solution. The in-situ esterification step with amyl alcohol as solvent and reactant was employed for the imide synthesis to eliminate and reduce possible crosslinking with the difunctional amine and to improve the homogeneity in the presence of the aromatic solvent. In the absence of the esterifying alcohol the addition of the diamine usually gives rise to severe crosslinking, which causes the reaction mixture to thicken and sometimes gel. The reaction sequence is shown below:

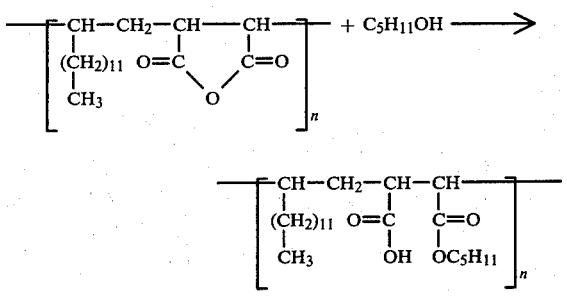

-continued

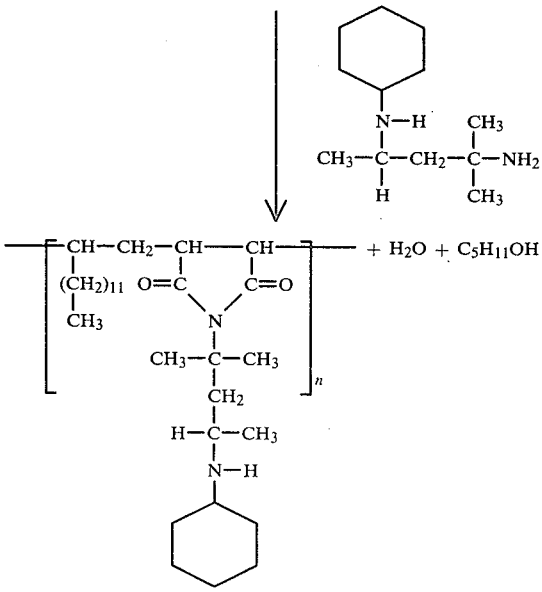

EXAMPLE 6A

This example describes the preparation of [octadecene-N-(N-cyclohexyl-2,4-diamino-2-methyl pentane)-maleimide] copolymer. The same procedure was employed as described in Example 5A using 35 g (0.1 m) (octadecene-maleic anhydride) copolymer (Example 4A).

Table 1. shows the unexpectedly high conductivity obtained when (Example 5A), tetradecene-N-(N-cyclohexyl-2,4-diamino-2-methyl pentane)maleimide copolymer is combined in various proportions with (Example 1) 1-decene-sulfur dioxide copolymer in kerosene.

TABLE 1

| Fuel: Kerosene Temperature: 70° F. | | |
|---|---|---|
| Example 1 Active ingredient (ppm) | Example 5A Active ingredient (ppm) | Conductivity (ps/m) |
| 0 | 0 | 2 |
| 0 | 1.0 | 20 |
| 0.1 | 0.9 | 390 |
| 0.2 | 0.8 | 390 |
| 0.3 | 0.7 | 400 |
| 0.4 | 0.6 | 380 |
| 0.5 | 0.5 | 380 |
| 0.6 | 0.4 | 355 |
| 0.7 | 0.3 | 340 |
| 0.8 | 0.2 | 300 |
| 0.9 | 0.1 | 215 |
| 1.0 | 0 | 40 |

The data clearly indicates the unexpectedly higher conductivity for the new antistatic additive composition. It can be seen, for example, that whereas the polysulfone (Example 1) alone at 1.0 ppm gives a conductivity of 40 C.U. and 1.0 ppm Example 5A alone gives a conductivity of 20 C.U. that the combination of 0.3 ppm Example 1 and 0.7 ppm Example 5A gives a conductivity of 400, considerably higher than expected.

The following Table 2. illustrates the increased electrical conductivity of various fuel oils containing the antistatic additives of this invention. The invention composition used in this evaluation consisted of combining 50 parts of the polysulfone copolymer (Example 1), 20% solution in toluene with 50 parts of the [octadecene-N(N-cyclohexyl-2,4-diamino-2-methyl pentane) maleimide] copolymer (Example 5A, 20% solution in toluene. For comparative purposes, data for two commercially available antistatic additives, designated A and B are also included. Commercial Additive A is a polymeric amide-acid salt while commercial additive B is a mixture of an olefin-sulfur dioxide copolymer with a polymeric polyamine.

TABLE 2

| Fuel Oil Conductivity Results Temperature 70° F. | | |
|---|---|---|
| Fuel Additive | Active Ingredient (ppm) | Conductivity (ps/m) |
| Fuel No. 1 - Diesel Oil (C.U. = 9) | | |
| Invention Composition (Ex. 1, Ex. 5A) | 0.5 | 190 |
| Invention Composition (Ex. 1, Ex. 5A) | 1.0 | 360 |
| Invention Composition (Ex. 1, Ex. 5A) | 2.0 | 650 |
| Comm. Additive A | 6.0 | 195 |
| Comm. Additive B | 3.0 | 210 |
| Example 1 | 1.0 | 10 |
| Example 5A | 1.0 | 20 |
| Fuel No. 2 - Gas Oil (C.U. = 4) | | |
| Invention Composition (Ex. 1, Ex. 5A) | 0.25 | 60 |
| Invention Composition (Ex. 1, Ex. 5A) | 0.50 | 115 |
| Invention Composition (Ex. 1, Ex. 5A) | 1.00 | 230 |
| Invention Composition (Ex. 1, Ex. 5A) | 2.00 | 450 |
| comm. Additive A | 9.00 | 205 |
| Comm. Additive B | 2.00 | 190 |
| Example 1 | 1.0 | 10 |
| Example 5A | 1.0 | 30 |
| Fuel No. 3 - Kerosene (C.U. = 2) | | |
| Invention Composition (Ex. 1, Ex. 5A) | 0.5 | 440 |
| Invention Composition (Ex. 1, Ex. 5A) | 1.0 | 860 |
| Comm. Additive A | 3.0 | 115 |
| Comm. Additive B | 1.5 | 310 |
| Example 1 | 1.0 | 20 |
| Example 5A | 1.0 | 40 |

The data in Table 2 clearly demonstrates the greater effectiveness of the new invention composition in increasing the electrical conductivities of various fuel oils. For example, in order to increase the conductivity of the diesel oil (Fuel No. 1) to about 200 C. U. Commercial Additive A needed 18 ppm and Commercial Additive B required 5 ppm, whereas the invention composition needed only 0.5 ppm.

It has also been found that the reaction product of an α-olefin/maleic anhydride copolymer with a long chain fatty alcohol and a diamine yields certain improved properties. The activity of this product, particularly in combination with the polysulfone, is more active and stable than the product made without the long chain alcohols. Although we do not wish to be bound by theoretical considerations, these improved properties may be attributed to the increased oil solubilizing properties imparted by the presence of the long straight chain alkyl groups. This reaction product is a complex polymeric compound containing various and randomized functional groups attached to a central backbone as shown below:

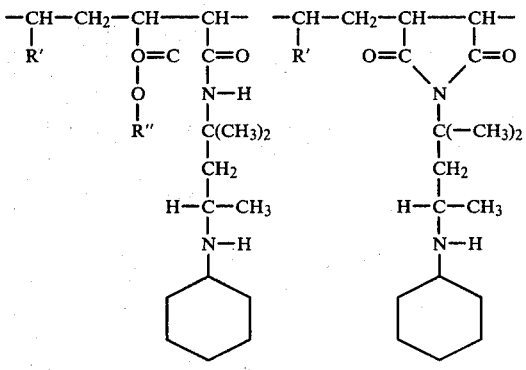

Unit III Unit IV

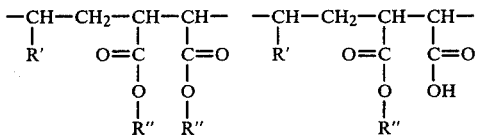

$R'=(CH_2)_{11-15}CH_3$ $R''=(CH_2)_{11-19}CH_3$

Depending on the particular reactants, conditions of reaction, the weight percent of each unit present may vary, for example, as follows:

| | |
|---|---|
| Unit I | 10–50% |
| Unit II | 50–90% |
| Unit III | 0–50% |
| Unit IV | 0–10% |

This complex polymeric chain, particularly in conjunction with the polymeric polysulfone component, undoubtedly performs a number of very important and specific funtions thereby contributing to the overall effectiveness of these anti-static agents. For example, the presence of a diamino functional group is essential. Replacement of the diamine with a monoamine results in a product that shows no activity. The type of diamine is also very important. The use of N-cyclohexyl-2,4-2,4-diamino-2-methylpentane (CDP), a very highly hindered diamine is particularly effective. The use of other less structurally hindered diamines results in cross-linked oil insoluble products or products with inferior antistatic activity. The presence of the long straight chain ester groups increases the oil solubility properties of the polymeric complex thereby assuring the complete dissolution of the active complex in such refined fuels as JP-4. The absence of these oil solubilizing groups results in lower activity and serious stability problems. A visual inspection of composition not containing these functional groups shows the formation of a gelatinous precipitate in JP-4 within 24 hours and a sharp decrease in the electrical conductivity of the fuel.

The molecular composition and configuration constituting the polymeric backbone of the monovinyl/-maleic anhydride copolymer of the present anti-static agents are very important for activity and storage stability. Of several types of both commercial and non-commercial monovinyl/maleic anhydride copolymers, the $C_{14}$–$C_{20}$ α-olefin/maleic anhydride copolymers was found to be the most effective. The excellent oil solubility of these esterified copolymers and their ability to react with diamine, without cross-linking so as to form insoluble products, may be responsible for their effectiveness.

Although we do not wish to be bound by theoretical considerations, the activity and aging stability of the new antistatic agents are believed to be dependent on the oil solubility characteristics of the complexes. The more oil soluble the mixture the higher the activity and greater the long term stability. It was found that both these conditions could be achieved by the partial or complete esterification of the monovinyl/maleic anhydride copolymer used in the preparation of (1-octadecene/maleic anhydride copolymer) (PA-18).

The effect of $C_5$ to $C_{20}$ straight chain alcohols, along with benzyl alcohol and several ethylene glycol ethers was studied using PA-18 and SMA-1000. With PA-18, the $C_{14}$ alcohol was the most effective closely followed by the $C_{13}$, $C_{16}$, $C_{18}$ and $C_{20}$ alcohols. The lower alcohols and ethylene glycol ethers had excellent initial activity but deteriorated rapidly on storage. The aromatic alcohol, benzyl alcohol was less effective and actually decreased the solubility of the complex in JP-4 fuel. In the case of the SMA-1000 (styrene/maleic anhydride copolymer), the $C_{13}$–$C_{20}$ alcohols were effective, however, they were less effective and more unstable than those derived from PA-18. The lower alcohols and the ethylene glycol ether gave either insoluble products or products that showed no antistatic effect. The esterification and subsequent aminolysis reaction was carried out as previously described.

The use of a polyfunctional amine or some other polyfunctional compound having an amino group present in the attached pendant side chain is a necessary requirement in the preparation of the polyamide/imide. The absence of this functional group in the side chain by the use of monoamines for example shows no activity. The type of amino group present in the pendant chain also significantly influences the activity of the antistatic agents. The test results indicate that the more hindered the amino group the higher the activity and greater the stability of the additive. This effect is probably due to the decreased cross-linking by the highly hindered diamine and the subsequent greater soulubility of the polymeric product. By far, the most effective amine tested was CDP.

EXAMPLE 7A

This example describes the procedure used to prepare the complex polymeric product derived from the monovinyl/maleic anhydride copolymer, alcohol and diamine. The typical procedure employed is described below using Gulf's PA-18.

| | | | |
|---|---|---|---|
| Charge: | PA-18 | = | 5.0 g (0.0143 M) |
| | Octadecanol | = | 7.8 g (0.029 M) |
| | CDP | = | 2.8 g (0.0143 M) |
| | xylene | = | 50 cc |
| | p-TSA | = | 0.1 g. |

Into a 300 ml flask equipped with stirrer, thermometer and reflux condenser equipped with a Dean Stark trap was placed the xylene, octadecanol and p-toluene sulfonic acid (p-TSA) used as a catalyst. The mixture was heated to 50° C. until there was a clear solution at which time the PA-18 was added and the mixture heated to reflux. The reaction was continued until the water of reaction ceased to distill from the mixture. The total reaction time was approximately 5 hours and 90% of the theoretical amount of water was collected. To the esterified solution, CDP (N-cyclohexyl-2,4-diamino-2-methylpentane) was added dropwise at 100° C. The mixture was then heated to reflux for about 5 hours while azeotroping any additional water produced. The clear free flowing solution was then diluted with xylene to make a 20% active solution.

This same procedure was employed in studying the effects of various monovinyl/maleic anhydride copolymers, alcohols and amines on the polyamide/imide/-ester component. The effect of several monovinyl/-maleic anhydride copolymers reacted according to Example 5A with CDP and octadecanol are shown in Table 3.

The effect of different alcohols are shown in Table 4.

The effect of various amines are shown in Table 5.

TABLE 3

Fuel = Kerosene (ps/m = 5)
Second component: 1-decene/$SO_2$ copolymer (Example 1)

| Maleic Anhydride copolymers | Comonomer | Conc. (ppm) | Conductivity (ps/m) |
|---|---|---|---|
| M-1715 | 1-tetradecene | 0.5 | >1000 |
| PA-18 | 1-octadecene | 0.5 | >1000 |
| SMA-1000 | styrene | 0.5 | 800 |
| Gantrez AN-139 | methyl vinyl ether | 0.5 | >1000 |
| *EMA-1103 | Ethylene | — | — |
| *EMA-31 | Ethylene | — | — |

*Cross-linked - insoluble

TABLE 4

Fuel: Kerosene (ps/m = 5)
2nd component: 1-decene/$SO_2$ copolymer (Example 1)

| Maleic Anhydride Copolymer | Amine | Alcohol | Conc. (ppm) | Conductivity (ps/m) Day 1 | Conductivity (ps/m) Day 10 |
|---|---|---|---|---|---|
| PA-18 | CDP | None | 0.5 | 600 | 400 |
| " | " | $C_5$ | 0.5 | 900 | 600 |
| " | " | $C_{14}$ | 0.5 | >1000 | >1000 |
| " | " | $C_{18}$ | 0.5 | 900 | 880 |
| " | " | $C_{20}$ | 0.5 | 860 | 860 |
| " | " | Benzyl alcohol | 0.5 | 680 | 600 |
| " | " | Butyl Cellosolve | 0.5 | 690 | 620 |
| " | " | Butyl Carbitol | 0.5 | 760 | 700 |

TABLE 5

Fuel: Kerosene (ps/m = 5)
2nd component: 1-decene/$SO_2$ copolymer (Example 1)

| Maleic Anhydride Copolymer | Amine | Alcohol | Conc. (ppm) | Conductivity (ps/m) |
|---|---|---|---|---|
| PA-18 | — | $C_{18}$ | 0.5 | 5 |
| " | CDP | $C_{18}$ | 0.5 | >1000 |
| " | Duomeen T | $C_{18}$ | 0.5 | 600 |
| " | *Jetamine DE-810 | $C_{18}$ | 0.5 | 450 |
| " | **Kemamine D-190 | $C_{18}$ | 0.5 | 425 |
| " | ***DMAPA | $C_{18}$ | 0.5 | 540 |
| " | t-octyl amine | $C_{18}$ | 0.5 | 50 |
| " | cyclohexylamine | $C_{18}$ | 0.5 | 40 |

*$CH_3(CH_2)_{5-7}CH_2O—(CH_2)_3NH—(CH_2)_3NH_2$
**N-90% Arochidyl-Behenyl
$CH_3(CH_2)_{17-19}CH_2—NH(CH_2)_3NH_2$
***DMAPA—Dimethylaminopropylamine In accordance with the present invention, improved liquid hydrocarbon compositions are provided containing an amount sufficient to impart antistatic properties to the antistatic agents of this invention.

In general, the present invention, in its preferred applications contemplates organic liquid compositions which normally are capable of accumulating a relatively large degree of electrostatic charge resulting in the aforementioned hazards of ignition and explosion, having incorporated therein a small amount of the aforementioned reaction product, usually from about 0.1 to about 200, and preferably from about 1 to about 10 pounds, per thousand barrels of the total volume of the liquid composition, i.e., from about 0.1 to 100 ppm, such as from about 0.2 to 50 ppm, but preferably from about 0.5 to 10 ppm.

A field of specific applicability of the present invention is in the improvement of organic liquid compositions in the form of petroleum distillate fuel oils having an initial boiling point from about 75° F. to about 135° F. and an end boiling point from about 250° F. to about 1000° F. It should be noted, in this respect, that the term "distillate fuel oils" is not intended to be restricted to straight-run distillate fractions. These distillate fuel oils can be straight-run distillate fuel oils, catalytically or thermally cracked (including hydrocracked) distillate fuel oils, or mixtures of straight-run distillate fuel oils, naphthas and the like, with cracked distillate stocks. Moreover, such fuel oils can be treated in accordance with well-known commercial methods, such as acid or caustic treatment, hydrogenation, solvent refining, clay treatment, and the like.

The distillate fuel oils are characterized by their relatively low viscosity, pour point and the like. The principal property which characterizes these contemplated hydrocarbons, however, is their distillation range. As hereinbefore indicated, this range will lie between about 75° F. and about 1000° F. Obviously the distillation range of each individual fuel oil will cover a narrower boiling range, falling nevertheless, within the above-specified limits. Likewise, each fuel oil will boil substantially, continuously, throughout its distillation range.

Particularly contemplated among the fuel oils are Nos. 1, 2 and 3 fuel oils, used in heating and as diesel fuel oils, gasoline, turbine fuels and the jet combustion fuels, as previously indicated. The domestic fuel oils generally conform to the specifications set forth in ASTM Specification D396-4ST. Specifications for diesel fuels are defined in ASTM Specification D975-48T. Typical jet fuels are defined in Military Specification MIL-F-56243.

Other fields of specific applicability of the present invention are: solvents, as used with paints; spot removers such as naphtha cleaners; textile compositions; pigments; liquid polishes; rubber compositions and the like. In brief, the antistatic agents of this invention can be used with a composition susceptible of accumulating a static electrical charge or a composition susceptible of generation of such a charge. Thus, a static electrical charge accumulated by such a composition can be reduced by coating a surface of the composition with one or more of the novel antistatic agents. For example, a fabric or fibre can be surface treated with one or more of the agents to reduce the susceptibility of the fabric or fibre to accumulate a static electrical charge.

While specific examples of this invention have been presented herein, it is not intended to limit the invention solely thereto, but to include all variations and modifications within the spirit of the invention. Thus, the copolymers of this invention can be employed as an antistatic agent alone or in combination with other known antistatic agents or those agents which enhance, by synergism, the effects of antistatic agents.

I claim:

1. An antistatic composition comprising an organic fluid containing an antistatic amount, in the concentration of 1 to 10 parts per million, of an antistatic agent consisting of (1) a polymer containing $\alpha$-olefin units selected from the group consisting of 1-decene, 1-dodecene, 1-tetradecene and 1-octadecene units and maleimide units and (2) a 1-decene-$SO_2$ copolymer, the ratio of maleimide copolymer to $SO_2$ copolymer being 100:1 to 1:100.

2. The polymer of claim 1 where the imide is derived from a diamine.

3. The polymer of claim 2 where the diamine has a sterically hindered amino group.

4. The polymer of claim 3 where the diamine has the formula

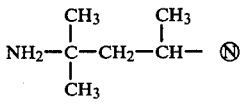

where Ⓝ is an amino group.

5. The antistatic composition of claim 1 wherein the maleimide polymer also contains acid, ester, and/or amide groups.

6. The antistatic composition of claim 1 where the antistatic agent is a 1-tetradecene-maleimide copolymer.

* * * * *